US006227172B1

(12) United States Patent
Katayama et al.

(10) Patent No.: US 6,227,172 B1
(45) Date of Patent: May 8, 2001

(54) FUEL INJECTED OUTBOARD MOTOR

(75) Inventors: Goichi Katayama; Yoshikazu Nakayasu, both of Shizuoka (JP)

(73) Assignee: Sanshin Kogyo Kabushiki Kaisha (JP)

( * ) Notice: Subject to any disclaimer, the term of this patent is extended or adjusted under 35 U.S.C. 154(b) by 0 days.

(21) Appl. No.: 09/471,886

(22) Filed: Dec. 23, 1999

(30) Foreign Application Priority Data

Dec. 25, 1998 (JP) ..... 10-370673

(51) Int. Cl.[7] ..... F02M 37/04
(52) U.S. Cl. ..... 123/463; 123/494; 123/456
(58) Field of Search ..... 123/463, 456, 123/184.53, 516, 494; 73/119 A, 861.47

(56) References Cited

U.S. PATENT DOCUMENTS

| | | | | |
|---|---|---|---|---|
| 4,276,862 | | 7/1981 | Matsumoto . | |
| 4,323,041 | | 4/1982 | Endo et al. . | |
| 4,395,991 | | 8/1983 | Miyachi et al. . | |
| 4,512,152 | | 4/1985 | Asaba . | |
| 5,261,231 | * | 11/1993 | Huh | 60/312 |
| 5,370,098 | | 12/1994 | Iida . | |
| 5,450,831 | | 9/1995 | Fukuoka . | |
| 5,476,426 | * | 12/1995 | Nakamura et al. | 477/115 |
| 5,704,334 | * | 1/1998 | Kato | 123/336 |
| 5,724,936 | | 3/1998 | Osakabe . | |
| 5,797,378 | | 8/1998 | Kato . | |
| 5,803,050 | * | 9/1998 | Osakabe et al. | 123/456 |
| 5,819,711 | | 10/1998 | Motose . | |
| 5,829,402 | | 11/1998 | Takahashi et al. . | |
| 5,862,794 | * | 1/1999 | Yoshioka | 123/486 |
| 5,878,726 | * | 3/1999 | Takahashi et al. | 123/516 |
| 5,899,197 | | 5/1999 | Watanabe et al. . | |
| 5,924,409 | | 7/1999 | Kato . | |
| 6,109,246 | * | 8/2000 | Takayanagi et al. | 123/516 |

* cited by examiner

*Primary Examiner*—Carl S. Miller
(74) *Attorney, Agent, or Firm*—Knobbe, Martens, Olson & Bear LLP

(57) ABSTRACT

An outboard motor has an induction system and a fuel supply system. The two systems are linked together to improve responsiveness of the fuel supply system based upon fluctuations in pressure within the induction system. The motor includes an induction air pressure detection system. The detection system comprises a pressure sensor and a connection to at least two different air intake pipes of the induction system. The connection between the sensor and the two pipes is configured such that the distance between the sensor and each of the pipes is the same. The detection system is configured to sample the pressure in multiple intake pipes associated with multiple cylinders using connecting conduits that have the same length from each intake pipe to the pressure sensor.

22 Claims, 6 Drawing Sheets

FUEL INJECTED OUTBOARD MOTOR

PRIORITY INFORMATION

This application is based on and claims priority to Japanese Patent Application No. Hei 10-370673, filed Dec. 25, 1998, the entire contents of which is hereby expressly incorporated by reference.

BACKGROUND OF THE INVENTION

1. Field of the Invention

The present invention generally relates to an induction system for a multi-cylinder engine. More particularly, the present invention relates to an induction air pressure detection arrangement for an engine of an outboard motor.

2. Description of the Related Art

Outboard motors are used to power marine vehicles. The outboard motors typically include an engine positioned within a protective cowling of the outboard motor. The outboard motor is then attached to the back of the watercraft and used to propel the watercraft in a forward or reversed direction. The outboard motors include induction systems that supply air to a combustion chamber for combustion with fuel supplied by a fuel supply system.

The induction system can include a sensor that approximates the air pressure within a component of the induction system such as an auxiliary passage. The sensor also has been connected to a single component, such as a single intake pipe, of the engine to approximate the air pressure within the system as a whole.

During engine operation, however, air flow through the auxiliary passage increases to a high flow rate. Accordingly, accurately monitoring the pressure within the passage becomes difficult. The rapid passage of air results in often unresolvable errors in the detection system. Accordingly, the sensor can be moved to a different region of the induction system that has a larger diameter and which is closer to the combustion chamber.

A single sensor, therefore, has been positioned proximate a single combustion chamber. The single sensor can more accurately reflect the pressure of the portion of the induction system with which it is associated. The sensor, however, does not reflect the pressure of the balance of the induction system in a very accurate manner. For instance, where the single sensor is associated with the intake pipe of a single cylinder, the sensor may not provide an accurate reading when the particular cylinder is disabled or otherwise malfunctioning. In addition, the single sensor is particularly incapable of reading pressures for each intake pipe just prior to induction of an air charge into each combustion chamber from the associated intake pipe.

SUMMARY OF THE INVENTION

Accordingly, a pressure detection system capable of accurately monitoring a pressure in each induction passage of a multi-cylinder engine is desired. The pressure detection system preferably includes a single sensor that is connected to more than one cylinder. Such a construction enables an accurate pressure comparison between cylinders. In addition, the connecting passages between the sensor and each of the passages preferably are of substantially the same length. In this manner, the phase differences from cylinder to cylinder can be better accommodated. Thus, detection of the pressure changes within the induction system has improved accuracy.

One aspect of the present invention involves an engine comprising a first cylinder and a second cylinder with the first cylinder including a first combustion chamber and the second cylinder including a second combustion chamber. The engine further comprises an induction system that is in fluid communication with the first combustion chamber and the second combustion chamber. The induction system comprises an intake chamber, a first intake conduit that communicates with the intake chamber and the first combustion chamber and a second intake conduit that communicates with the intake chamber and the second combustion chamber. An induction air pressure detection system is operatively connected with the induction system. The detection system comprises an induction air detection pressure sensor. The pressure sensor communicates with the first intake conduit through a first combined conduit path and with the second intake conduit through a second combined conduit path. The first combined conduit path and the second combined conduit path have substantially the same length.

In a preferred mode, the induction system includes a first throttle device that is positioned between the first intake conduit and the intake chamber and a second throttle device that is positioned between the second intake conduit and the intake chamber. The pressure sensor communicates with first intake conduit downstream of the first throttle device with the second intake conduit downstream of the second throttle device.

Another aspect of the present invention involves a multi-cylinder engine comprising multiple cylinders formed within a cylinder block. A set of corresponding multiple cylinders are disposed within the multiple cylinders. A cylinder head is connected to the cylinder block and contains a set of multiple recesses corresponding with the multiple cylinders. Multiple combustion chambers are formed by a corresponding grouping of the pistons, cylinders and cylinder heads. An induction air passage communicates with each of the multiple combustion chambers through corresponding multiple intake pipes. A set of multiple fuel injectors are provided such that each of the multiple intake pipes has at least one of the set of multiple fuel injectors associated therewith. The fuel injectors inject fuel to form a fuel/air charge in the combustion chambers. A fuel rail supplies fuel to the fuel injectors and is connected to a pressure regulator. A pressure sensor is placed in communication with two or more of the multiple intake pipes through a multi-part induction air pressure pipe. A length of the multi-part induction air pressure pipe between the pressure sensor and each of the two or more of the multiple intake pipes is substantially the same.

In a preferred mode, each of the multiple intake pipes includes a throttle device that controls a flow of air through the corresponding intake pipe. The pressure sensor communicates with the multiple intake pipes through the air pressure pipe at a location downstream from the throttle devices.

These and other features, aspects and advantages of the present invention will become apparent from the detailed description of a preferred embodiment that follows.

BRIEF DESCRIPTION OF THE DRAWINGS

The present invention will now be described with reference to the drawings of a preferred embodiment, which embodiment is intended to illustrate, but not to limit, the present invention, and in which figures.

DETAILED DESCRIPTION OF A PREFERRED EMBODIMENT OF THE PRESENT INVENTION

Figure 1:
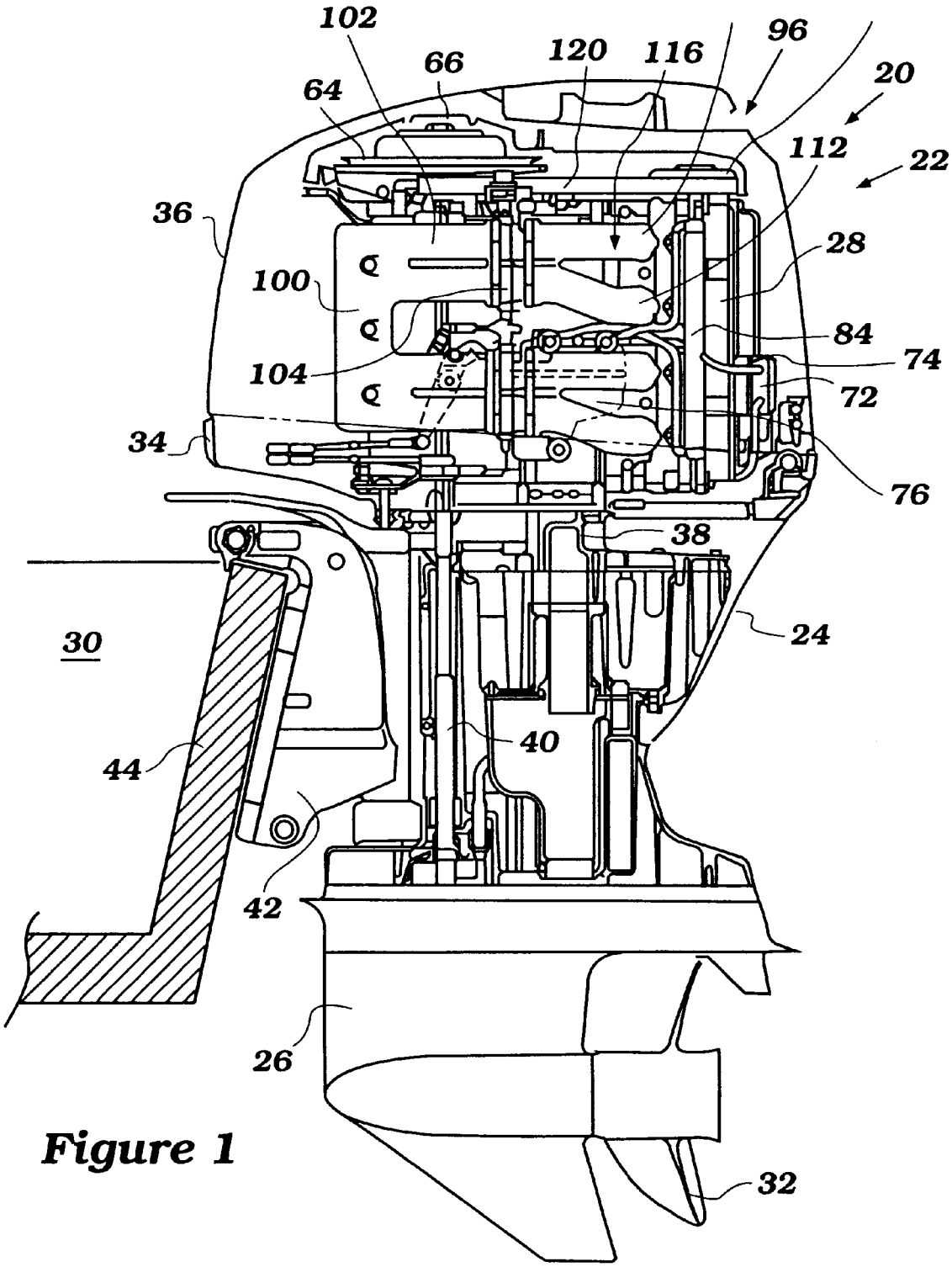
FIG. 1 is a partially sectioned side elevational view of an outboard motor having an engine and fuel supply system arranged and configured in accordance with certain features, aspects and advantages of the present invention.

With reference initially to FIG. 1, an outboard motor, indicated generally by the reference numeral 20, is illustrated therein. The illustrated outboard motor 10 advantageously incorporates a fuel system and induction system configured and arranged in accordance with certain features, aspects and advantages of the present invention. The configuration results in improved engine performance during various operating conditions of the engine. Although the present invention is described in conjunction with the illustrated outboard motor, it should be understood that certain features, aspects and advantages of the present invention can also be used in other applications such as, for example, but without limitation, in other marine drive units (e.g., an inboard engine of an inboard/outboard drive) and in a variety of other land-based vehicles and engine applications.

The illustrated outboard motor 10 generally comprises a powerhead 22, a driveshaft housing 24, and a lower unit 26. The powerhead 22 preferably includes an internal combustion engine 28 that is used to power a watercraft 30 to which the outboard motor is mounted. The mid section or driveshaft housing 24 extends downward below the powerhead 22 and contains portions of an exhaust system associated with the engine 28 as well as a driveshaft as will be described. The lower unit 26 typically includes a transmission and journals a propulsion shaft that drives a propeller 32.

The powerhead 22 generally includes a protective cowling which surrounds the engine 28. The cowling generally comprises both a lower tray portion 34 and an upper main cover portion 36. Typically, the main cover portion 36 is hingedly connected to the lower tray portion 34, or otherwise removably affixed to the lower tray portion 34, such that the engine 28 may be accessed by removing the main cover portion 36 from the lower tray portion 34. In addition, the joint between the lower tray portion 34 and the main cover portion 36 preferably is provided with a seal or other type of water tight connection such that water infiltration can be reduced or minimized. Such a construction results in improved protection of the engine 28 from ingesting of water during operation.

With continued reference to FIG. 1, the mid section 24 contains an exhaust guide plate 38 to which the engine is typically mounted in a conventional manner. Thus, the engine 28 is connected to the balance of the outboard motor 20 in the illustrated embodiment through the use of the exhaust guide plate 38. In addition, the exhaust guide plate 38 forms a portion of the exhaust system which will be described in greater detail below.

As mentioned above, the lower unit 26 preferably includes a transmission to transfer power from a driveshaft 40 to the impeller or propeller 32. Preferably, the transmission is a forward/neutral/reverse type transmission. This type of transmission enables the watercraft to be driven in any of these operational states. The transmission selectively establishes a driving condition of the propeller 32. Of course, as will be recognized by those of ordinary skill in the art, the propeller 32 can be replaced by any other known or suitable propulsion device. For instance, but without limitation, the propulsion device 32 could be jet pump unit.

As is generally known to those of ordinary skill in the art, the present outboard motor 10 can be attached to the watercraft 30 using a clamp and swivel bracket 42. As illustrated, the clamp and swivel bracket 42 is configured to attach the outboard motor 10 to the watercraft 30 along a transom or rear wall 44. The bracket 42 enables the motor 20 to be both steered about a generally vertical axis and tilted or trimmed about a generally horizontal axis. As the bracket 42 forms no part of the present invention per se, further description thereof is unnecessary.

Figure 2:
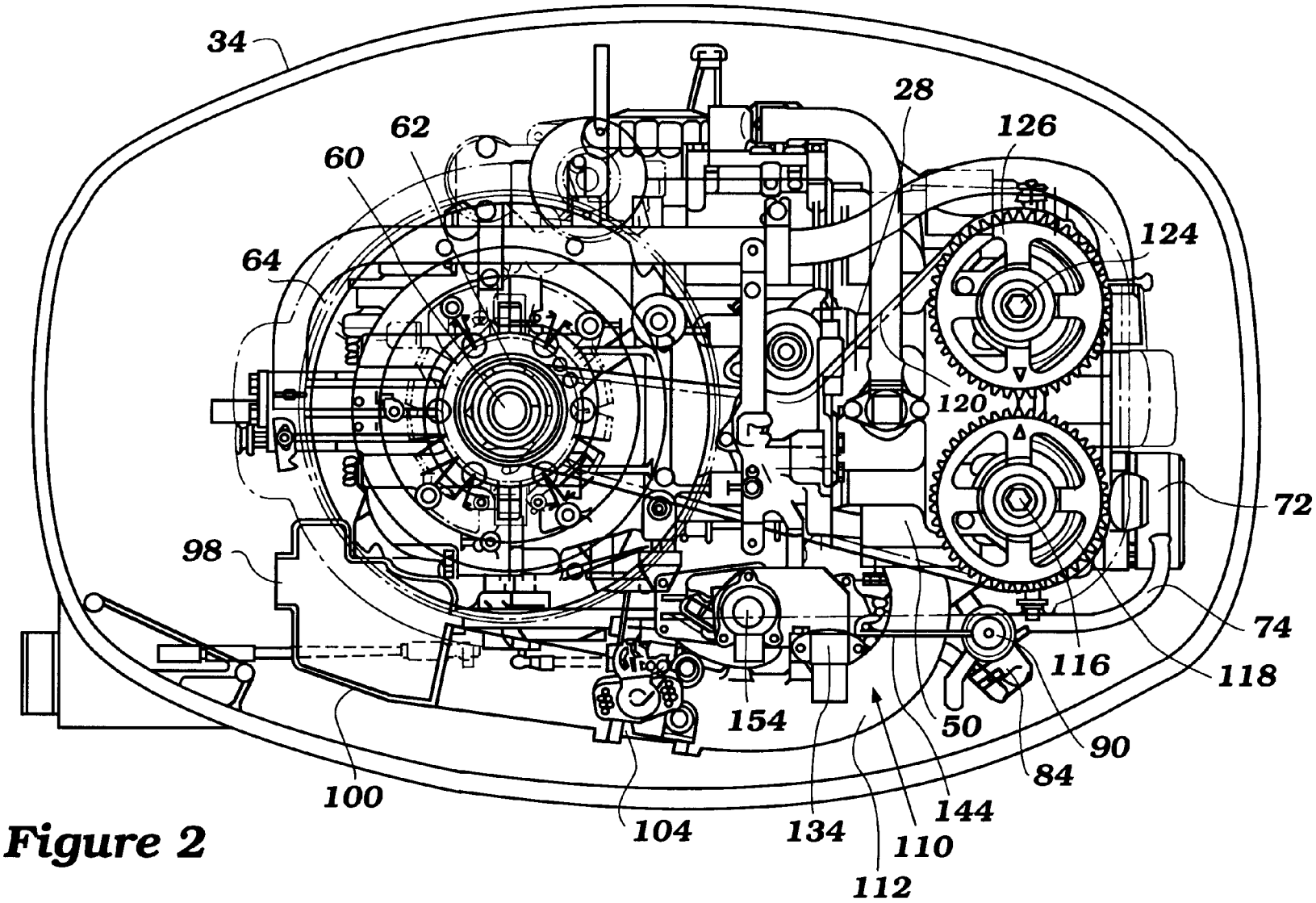
FIG. 2 is a top plan wire frame view of the outboard motor of FIG. 1.

With reference now to FIG. 2, the illustrated engine 28 is preferably of the inline type. More preferably, the engine 28 is of the four-cylinder, four-cycle type. In some arrangements, the engine can have greater or lesser numbers of cylinders and can be arranged to have a pair of banks having a generally V configuration. Of course, other cylinder block configurations and cylinder arrangements can also benefit from certain features, aspects and advantages of the present invention.

Figure 3:
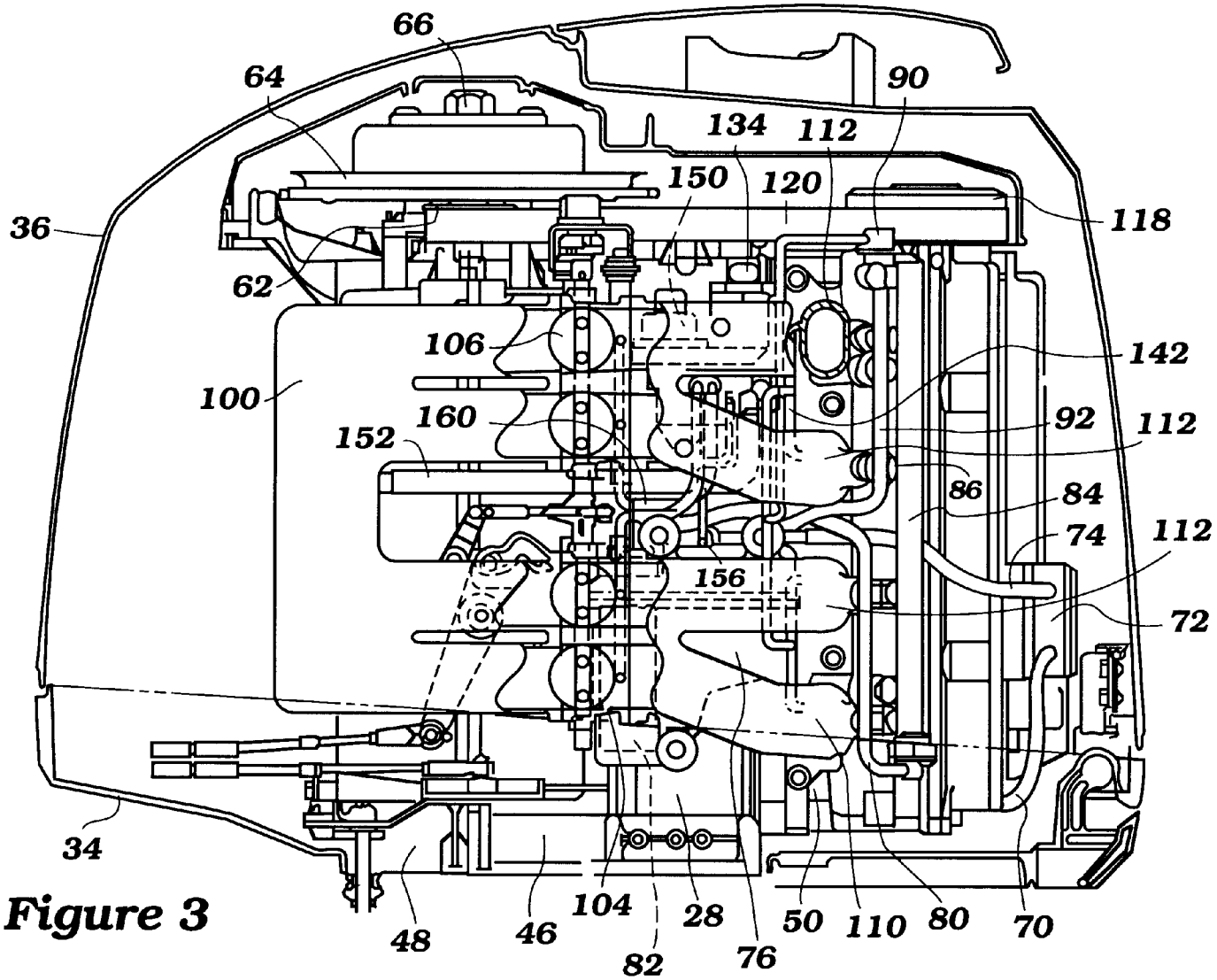
FIG. 3 is a partial side elevation wire frame view of the engine of the outboard motor of FIG. 1.
Figure 4:
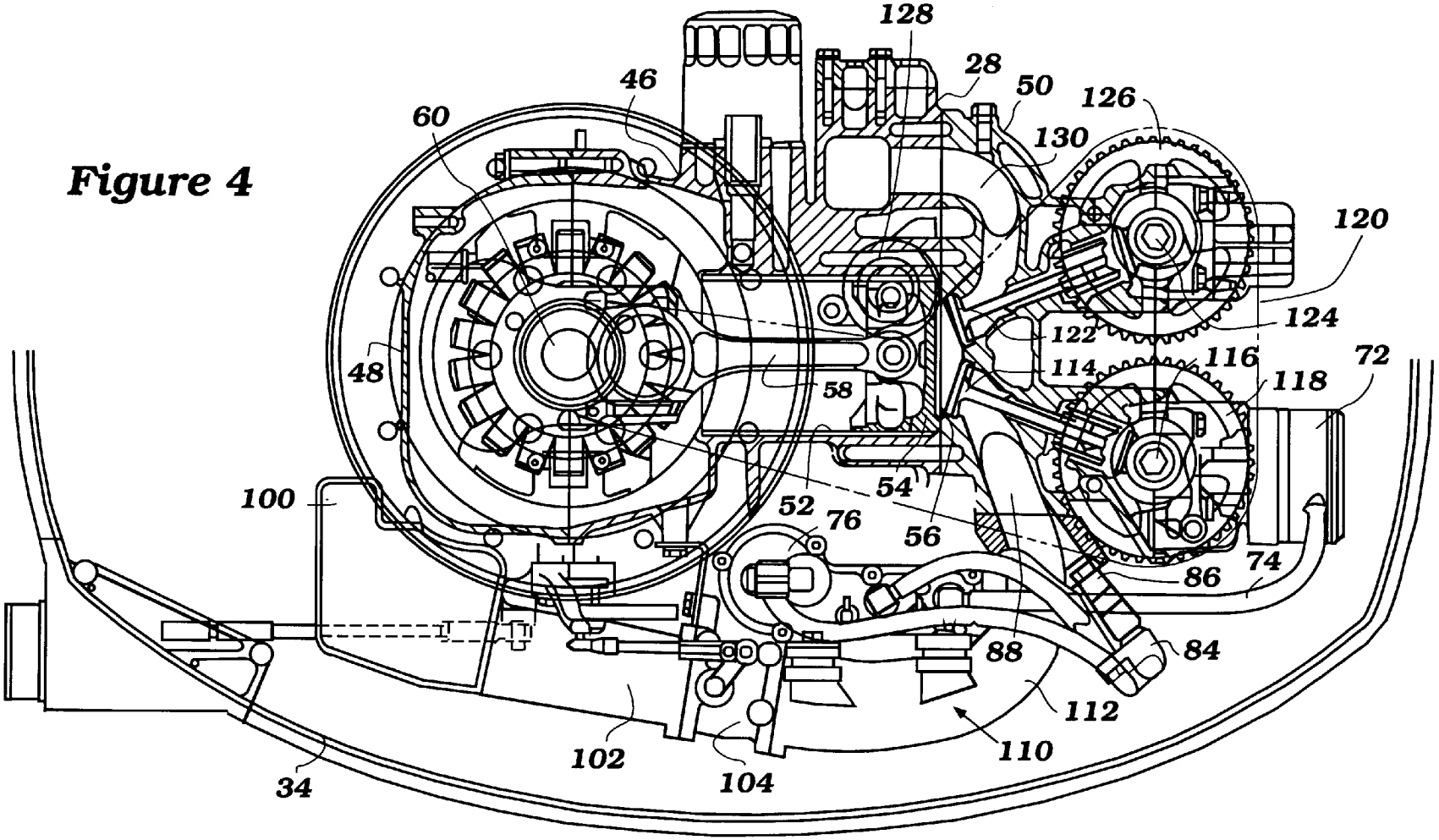
FIG. 4 is a partial top plan wire frame view of the engine of the outboard motor of FIG. 1.

With reference now to FIGS. 3 and 4, the engine 28 generally comprises a cylinder block 46, a crankcase 48, and a cylinder head 50. As is generally known, the cylinder block 46 is interposed between the cylinder head 50 and the crankcase 48. The crankcase, as used herein, generally refers to the crankcase member forming the crankcase member.

With continued reference to FIG. 4, the cylinder block 46 contains a number of bores that define cylinders 52. The cylinders 52 may be formed directly in the cylinder block 46 and may include a sleeve or a plated surface. As described above, the engine 28 desirably includes four inline cylinders 52; however, other configurations are also possible.

A set of pistons 54 are positioned in corresponding cylinders 52. The pistons reciprocate within the cylinders as a result of combustion occurring in combustion chamber 56. With continued reference to FIG. 4, a combustion chamber 56 is defined by recesses formed within the cylinder head 50 and by the cylinder wall 52 and the head of the piston 54.

Each of the pistons 54 is connected to a first end of a connecting rod 58 by pins in a known manner. The connecting rod 58 also includes a large end that is attached to a portion of a crankshaft 60. More specifically, the connecting rod 58 is rotatably connected to a throw of the crankshaft 60. Thus, reciprocal movement of the piston 54 within the cylinder 52 causes rotational movement of the crankshaft 60, which is journaled in a suitable manner in a crankcase chamber.

The crankshaft 60 generally is positioned in a substantially vertical orientation. such that the crankshaft 60 rotates about a generally vertical axis. This orientation facilitates coupling of the crankshaft 60 to the driveshaft 40. In addition, this orientation helps maintain a compact arrangement for the outboard motor 20.

With reference again to FIGS. 1 and 3, a drive pulley 62 and a flywheel 64 preferably are connected to an upper end of the illustrated crankshaft 60. As illustrated in FIG. 1, the flywheel 64 is held in position on the crankshaft 60 through the use of a nut 66. Of course, other suitable mounting arrangements can also be used. In addition, the flywheel 64 and the drive pulley 62 can be positioned at other points along the crankshaft and driveshaft combination. However, the illustrated arrangement results in a fairly compact structure of the outboard motor 20. As is generally known, the flywheel 64 may include a starter ring that is selectively engaged by a starter motor during starting of the engine 28 of the outboard motor 20.

Figure 5:
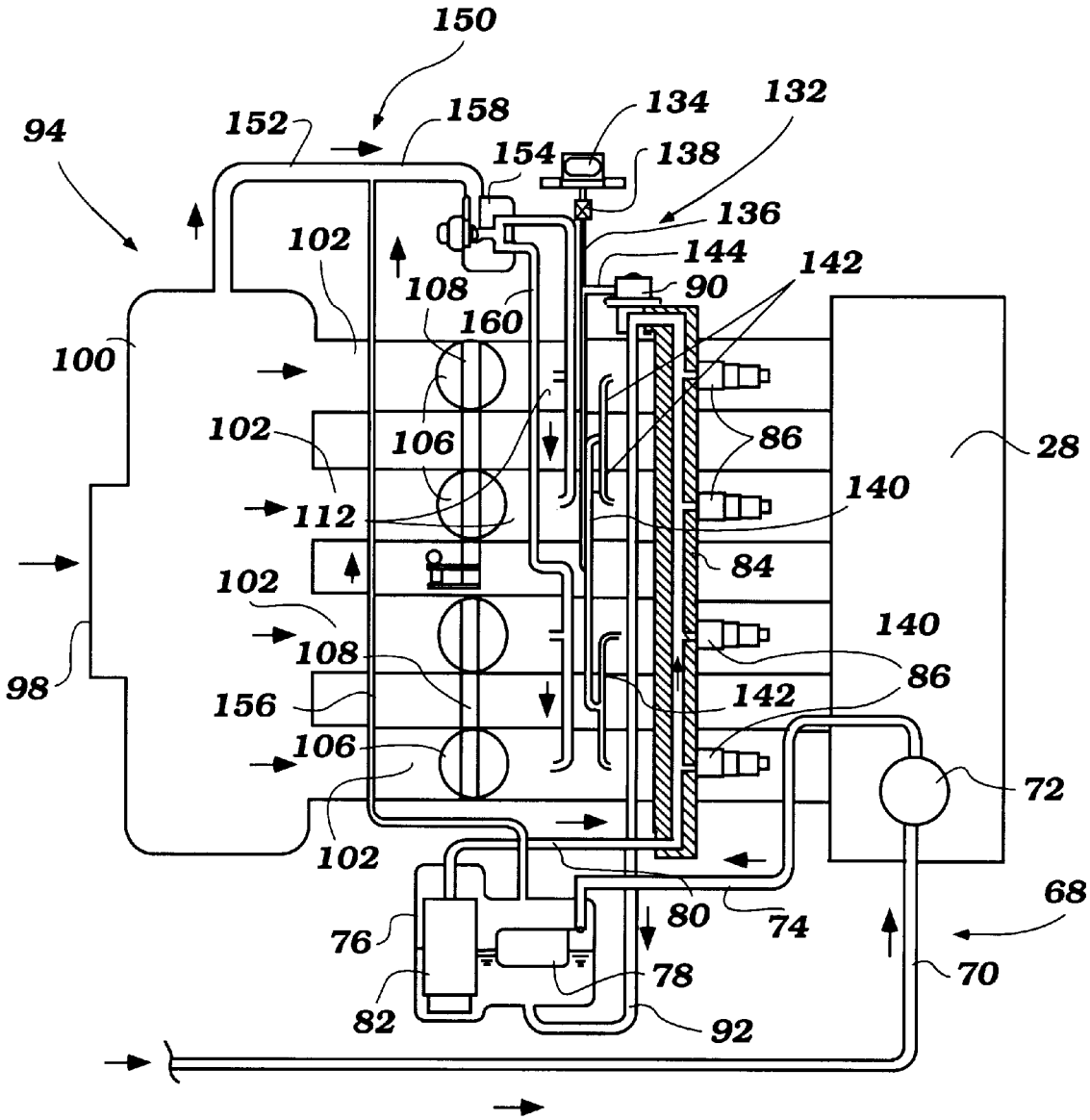
FIG. 5 is a schematic illustration of a fuel supply system and an air induction system of the engine of the outboard motor of FIG. 1.
Figure 6:
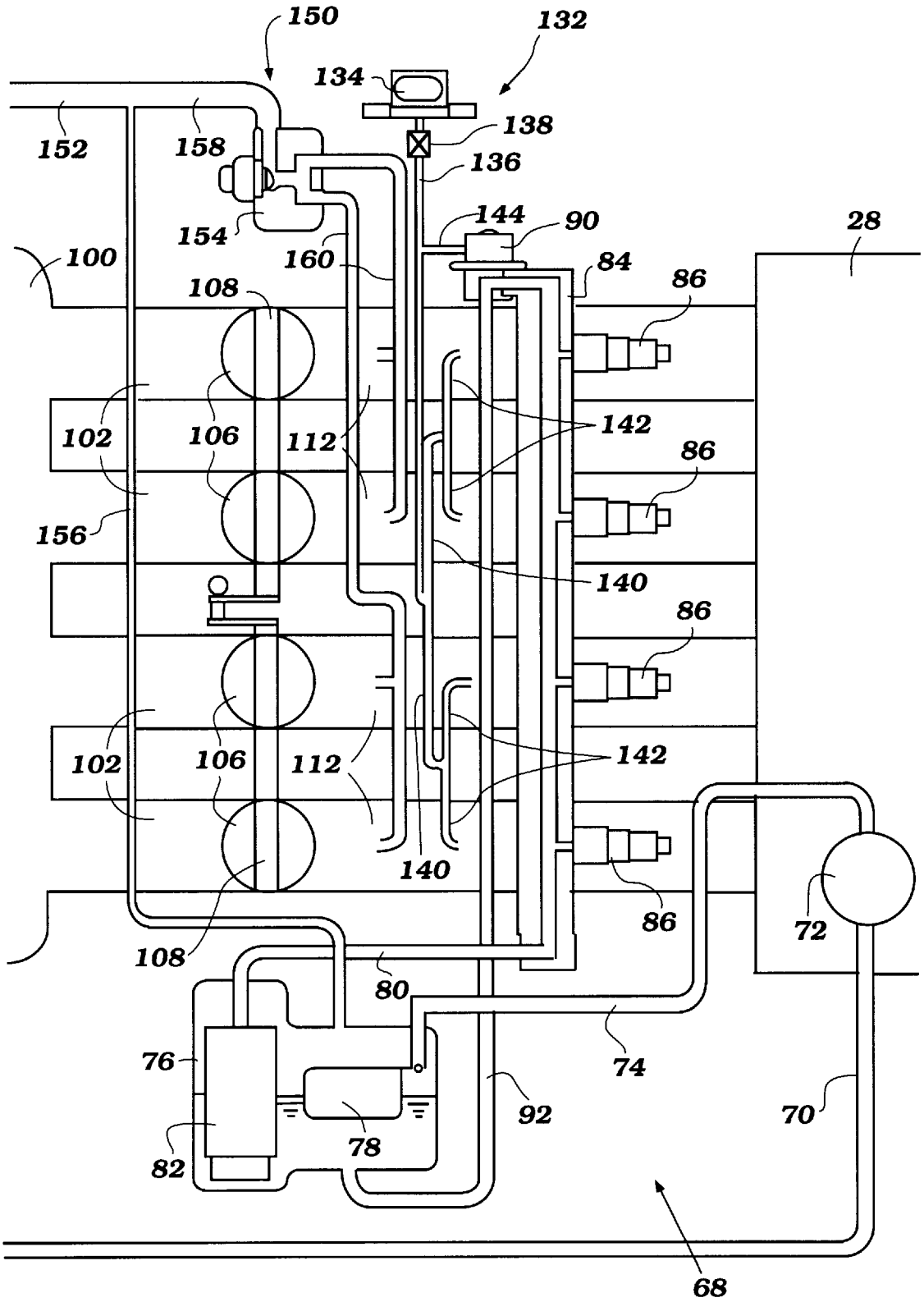
FIG. 6 is an enlarged view of a portion of FIG. 5, illustrating an induction air pressure sensor arrangement.

With reference now to FIGS. 5 and 6, the outboard motor 20 preferably includes a fuel supply system 68. The fuel supply system provides a charge of fuel for combustion within the combustion chambers 56. As illustrated, fuel is drawn from an onboard fuel tank (i.e., the fuel tank is positioned in the hull of the watercraft 30) through a first delivery line 70. The fuel can be pumped into the fuel delivery line 70 from the fuel tank by a first low pressure fuel pump (not shown). Of course, other pumping arrangements can also be used.

The fuel also is pumped by a second low pressure fuel pump 72 in the illustrated engine 28. The low pressure fuel pump 72 preferably is a diaphragm-type pump that is operated by pressure variations within the crankcase 48. Accordingly, the fuel pump 72 operates at a fairly low pressure.

The low pressure fuel pump delivers fuel through a second delivery line 74 to a vapor separation tank 76. The flow of fuel through the second delivery line 74 preferably is controlled by a float valve 78. The float valve 78 includes a float that rises and falls with the level of fuel within the vapor separation tank 76. As the level of fuel rises, the float also rises, thereby closing the valve 78 and stopping the flow of fuel through the delivery line 74. As the level of fuel falls within the vapor separation tank 76, the float is lowered, thereby opening the valve 78 and allowing fuel to flow through the delivery line 74. Preferably, the vapor separation tank 76 is located at about the same level as the fuel pump to decrease the effects of gravity on the head of fuel being supplied by the fuel pump 72.

With continued reference to FIGS. 5 and 6, the fuel is provided from the vapor separation tank 76 to a discharge pipe 80. More specifically, a high pressure fuel pump 82 that is preferably positioned within the vapor separation tank 76 pumps fuel through the discharge pipe 80 under a high pressure. The discharge pipe 80 is in registry with a fuel rail 84. The fuel rail 84 extends in a generally vertical direction and supplies fuel to each of a plurality of fuel injectors 86.

With reference now to FIG. 4, the fuel injector 86 preferably is mounted to the cylinder head 50 along an intake passage 88 formed in the cylinder head 50. The intake passage 88 will be described in greater detail below. The pressure within the fuel rail 84, and therefore the fuel injectors 86, is controlled by a pressure regulator 90. The pressure regulator 90 operates in any suitable manner to control the pressure building within the fuel rail 84. In the illustrated embodiment, the pressure regulator 90 returns a portion of the fuel passing through the fuel rail 84 back to the vapor separation tank 76 through a return line 92.

With reference to FIGS. 5 and 6, the return line 92 empties into a lower portion of the vapor separation tank 76 and therefore operates against the head of fuel contained in the vapor separation tank 76. Of course, other arrangements can also be used.

With reference again to FIGS. 5 and 6, the outboard motor 20 also includes an induction system 94. The induction system 94 supplies air to the combustion chambers 56 for combustion along with the charger fuel provided by the fuel supply system 58.

With reference now to FIG. 1, the outboard motor 20 has a vent 96 formed in the main cowling portion 36 of the powerhead 22. The vent admits air from a rearwardly facing portion of the outboard motor 20 into an engine compartment defined within the powerhead 22. The air flows through the vent and into the engine compartment and is drawn into the induction system 94 through an air inlet 98. The air inlet 98 is formed on a forwardly facing portion of a plenum chamber 100. The plenum chamber provides a large volume of air from which a plurality of individual air intake pipes 102 can draw air. In some arrangements, the plenum chamber is used to tune the induction system as is generally known.

With reference again to FIG. 1, a plurality of throttle valve body 104 are placed in communication with the plenum chamber 100 by the illustrated intake pipes 102. In the illustrated arrangement, there are four intake pipes and four corresponding throttle valve bodies 104. As is generally known, throttle valve bodies 104 include valves 106 that each rotate on a valve shaft 108. In the illustrated arrangement, two valves 106 are mounted on each valve shaft 108 such that there are two valve shafts 108 associated with the induction system 94. The valves open and close the air flow path through the intake pipes 102 and more specifically through the throttle valve bodies 104 to control the amount of air being inducted into the engine 28. The valves may be actuated using any suitable actuation mechanism such that the flow of air can be controlled by an operator according to the speed at which the operator desires the engine 28 to be run.

Downstream of the throttle valve bodies 104 are located induction manifolds 110. In the illustrated arrangement, two induction manifolds 110 are provided and each corresponds to two of the intake pipes 102 and throttle valve bodies 104. The induction manifold 110 includes separate runners 112 that place a throttle valve body 104 in communication with the intake passage 88 of the corresponding cylinder 52. As described above, fuel injectors 86 inject a charge of fuel into the inducted air supply just prior to entry into the intake passages 88 formed within the cylinder head. It is also anticipated, however, that the fuel injectors 86 could be positioned in other locations to properly inject fuel into the air supply prior to combustion within the engine.

The induction of air through the air intake passages 102, 104, 112, 88 desirably is controlled by an intake valve 114. The intake valve 114 closes an intake port in a known manner. It is operated through the use of an intake cam arrangement as is generally known to those of skill in the art. The intake cam arrangement includes an intake cam shaft 116 that carries an intake cam pulley 11 8. The intake cam pulley 118 is driven by a timing belt 120 that loops around the drive pulley 62 attached to the crankshaft 60. Preferably, the cam pulley 118 is as twice the diameter of the drive pulley 62 such that for each revolution of the crankshaft 60, the cam shaft 116 only returns half of a revolution.

Following combustion within the combustion chamber 56, exhaust gases are removed from the combustion chamber 56 through an exhaust port. The exhaust port is selectively opened and closed by the use of an exhaust control valve 122. The exhaust control valve is similarly controlled by a cam arrangement such as that described above in the context of the intake valve 114. Specifically, an exhaust cam shaft 124 selectively opens and closes the exhaust control valve 122 in a known manner. The exhaust cam shaft 124 carries a pulley 126 that is also driven by the timing belt 120. As illustrated, the timing belt 120 can be tensioned using a tension pulley or idler pulley 128. Also, as discussed above, the pulley 126 preferably has twice the diameter of the drive pulley 62 such that two revolutions of the crankshaft 60 are required to cause a single revolution of the cam pulley 126.

As exhaust passes through the exhaust port when the exhaust control valve 122 is opened, the gas is passed through an exhaust passage 130 formed within the cylinder head 50. The exhaust gases are then passed from the engine and out to the environment through any suitable exhaust system that is connected to the engine, as is generally known to those of ordinary skill in the art. For instance, the exhaust gases may pass through an exhaust manifold, into an exhaust guide plate, through the exhaust guide plate, and into the body of water through the hub of the propeller 32. Of course, other arrangements can also be used.

The outboard motor 20 also features an induction air pressure detection system 132. The system 132 features an induction air pressure sensor 134. The sensor 134 preferably is positioned proximate the runners 112 of the induction manifold 110. More preferably, the sensor 134 is in simultaneous registry with each of the runners 112. Of course, the sensor 134 could be arranged to be a simultaneous registry with fewer than all of the runners in some applications.

A pipe 136 is connected to the sensor 134 through a filter 138. The pipe 136 is sized to allow pressure variations at one end of the pipe 136 to be detected at the other end of the pipe, which is connected to the sensor 134.

With reference to FIGS. 5 and 6, the pipe 136 is connected to a pair of branch pipes 140 in the illustrated arrangement. Advantageously, the juncture between the pair of branch pipes 140 and the pipe 136 is centrally positioned among the two central cylinders of the cylinder bank.

The branch pipes 140, in turn, extend from the juncture with the pipe 136 to a set of tertiary pipes 142. Preferably, the junctures between the branch pipes 140 and the tertiary pipes 142 are centralized between a pair of adjoining cylinders. Thus, the tertiary pipes 142 are substantially the same length from the juncture with the branch pipe 140 to the end disposed within the intake manifold or runner 112. Preferably, the overall combined length of the tertiary pipes 142, the branch pipes 140 and the pipe 136 is substantially the same. In other words, the combined length of piping from the sensor 134 to the end of each tertiary pipe 142, which is positioned within the intake runner 112, is substantially the same for each cylinder. Such a construction advantageously improves the operation of the sensor arrangement.

The pipe 136, branch pipes 140 and tertiary pipes 142 together function as a balance passage and connect the runners 112 to one another so as to generally balance the pressure from runner 112 to runner 112. The preferred embodiment illustrates the pipes 136, 140, 142 as external components; however, at least portions of these passages can be internally formed within the intake manifolds.

The balance passage also communicates with the fuel pressure regulator 90 to improve control of the fuel injection system. In the illustrated embodiment, a connecting duct 144 extends from an upper portion of the illustrated pipe 136 to the fuel pressure regulator 90. Thus, the fuel pressure can be more closely tied to the pressure of air in any individual intake passage at the time of injection into that intake passage or associated cylinder.

The illustrated outboard motor 20 also includes an idle speed control system 150. The idle speed control system 150 advantageously improves engine performance under a variety of operating conditions. With reference now to FIGS. 5 and 6, the idle speed control 150 will be described in greater detail. As illustrated therein, an incoming bypass passage 152 draws a secondary supply of air from the plenum chamber 100. The passage 152 extends to an idle speed controller or ISC 154. More specifically, the air flow flowing through the incoming bypass passage 152 is merged with a flow of ventilation vapor coming through a ventilation duct 156 that originates within the vapor separation tank 76. The vent duct 156 provides a vent for gases building up within the vapor separation tanks 76. The ventilation duct 156 merges with the incoming bypass passage 152 and the combined gas and air flow passes through a merged flow conduit 158 to the ISC 154. The flow through the merged flow conduit 158 is controlled by the ISC in a manner which will be described in further detail below. A split pair of outgoing conduits 160 extend from the ISC 154 into the air flow downstream of the throttle valves 106 in the intake manifold 110.

Although this invention has been described in terms of a certain preferred embodiment, other embodiments apparent to those of ordinary skill in the art are also within the scope of the present invention. In addition, not all features, aspects or advantages of the present invention are necessarily required to practice certain other portions of the present invention. Accordingly, the scope of the present invention is intended to be defined only by the claims that follow.

What is claimed is:

1. An engine comprising a first cylinder and a second cylinder, the first cylinder including a first combustion chamber and the second cylinder including a second combustion chamber, the engine further comprising an induction system that is in fluid communication with the first and second combustion chambers, the induction system comprising an intake chamber, a first intake conduit that communicates with the intake chamber and the first combustion chamber, a second intake conduit that communicates with the intake chamber and the second combustion chamber;

an induction air pressure detection system being operatively connected with the induction system, the detection system comprising an induction air detection pressure sensor, the pressure sensor communicating with the first intake conduit through a first combined conduit path and with the second intake conduit through a second combined conduit path, and the first combined conduit path and the second combined conduit path having substantially the same length.

2. The engine of claim 1, wherein the induction system additionally comprises a first throttle device being positioned between the first intake conduit and the intake chamber, a second throttle device being positioned between the second intake conduit and the intake chamber, and the pressure sensor communicates with the first and second intake conduits downstream of the respective throttle devices.

3. The engine of claim 1, wherein the first cylinder and second cylinder are positioned side-by-side.

4. The engine of claim 3 additionally comprising a pressure regulator that forms a portion of a fuel supply system including multiple fuel injectors, the pressure regulator being configured to alter a fuel pressure associated with the multiple fuel injectors, the pressure regulator being connected to the induction air pressure detection system.

5. The engine of claim 4, wherein the pressure regulator is connected to the induction air pressure detection system along a common portion of the first combined conduit path and the second combined conduit path.

6. The engine of claim 1, wherein the first combined conduit path connects to the first intake conduit on an upper portion of the first intake pipe and the second combined conduit path connects to the second intake pipe on an upper portion of the second intake conduit.

7. The engine of claim 1 further comprising a third cylinder and a fourth cylinder having a third combustion chamber and a fourth combustion chamber respectively, a third intake conduit communicating with the intake chamber and the third combustion chamber, a fourth intake conduit communicating with the intake chamber and the fourth combustion chamber, the first cylinder, second cylinder, third cylinder and fourth cylinder being formed in a line, and the third cylinder and the fourth cylinder being positioned between the first cylinder and the second cylinder.

8. The engine of claim 7 further comprising a third combined conduit path, the pressure sensor communicating with the third intake conduit through the third combined conduit path, and the first combined conduit path, the second combined conduit path and the third combined conduit path having substantially the same lengths.

9. The engine of claim 8 further comprising a fourth combined conduit path, the pressure sensor communicating with the fourth intake conduit through the fourth combined conduit, and the first combined conduit path, the second combined conduit path, the third combined conduit path and the fourth combined conduit path having substantially the same lengths.

10. The engine of claim 1 further comprising a third cylinder and a fourth cylinder having a third combustion chamber and a fourth combustion chamber respectively, a third intake conduit communicating with the intake chamber and the third combustion chamber, a fourth intake conduit communicating with the intake chamber and the fourth combustion chamber, the first cylinder, second cylinder, third cylinder and fourth cylinder being formed in a line, the third cylinder being positioned between the first cylinder and the second cylinder and the second cylinder being positioned between the third cylinder and the fourth cylinder.

11. The engine of claim 10 further comprising a third combined conduit path, the pressure sensor communicating with the third intake conduit through the third combined conduit path, and the first combined conduit path, the second combined conduit path and the third combined conduit path having substantially the same lengths.

12. The engine of claim 11 further comprising a fourth combined conduit path, the pressure sensor communicating with the fourth intake conduit through the fourth combined conduit path, and the first combined conduit path, the second combined conduit path, the third combined conduit path and the fourth combined conduit path having substantially the same lengths.

13. The engine of claim 10, wherein the induction system additionally comprises a third throttle device being positioned between the third intake conduit and the intake chamber, a fourth throttle device being positioned between the fourth intake conduit and the intake chamber, and the pressure sensor communicates with the third and fourth intake conduits downstream of the respective throttle devices.

14. A multi-cylinder engine comprising multiple cylinders formed within a cylinder block, a set of corresponding multiple cylinders being disposed within the multiple cylinders, a cylinder head being connected to the cylinder block and containing a set of multiple recesses corresponding with the multiple cylinders, multiple combustion chambers being formed by a corresponding grouping of the pistons, the cylinders and the cylinder heads, an induction air passage communicating with each of the multiple combustion chambers through corresponding multiple intake conduits, a set of multiple fuel injectors being provided such that each of the multiple intake conduits has at least one of the set of multiple fuel injectors associated therewith, the fuel injectors injecting fuel into the combustion chambers from a fuel rail, the fuel rail being connected to a pressure regulator, a pressure sensor being placed in communication with two or more of the multiple intake conduits through a multi-part induction air pressure conduit, a length of the multi-part induction air pressure conduit between the pressure sensor and each of the two or more of the multiple intake conduits being substantially the same.

15. The multi-cylinder engine of claim 14, wherein the pressure regulator is connected to the multi-part induction air pressure conduit by a separate conduit.

16. The multi-cylinder engine of claim 14, wherein the multi-part induction air pressure conduit comprises a common conduit extending at least part of the length between the pressure sensor and each of the two or more of the multiple intake conduits.

17. The multi-cylinder engine of claim 16, wherein the multi-part induction air pressure conduit also comprises a pair of branches leading from the common conduit.

18. The multi-cylinder engine of claim 17, wherein a separate conduit extends from the common conduit proximate the pressure sensor to the pressure regulator.

19. The multi-cylinder engine of claim 18 further comprising a filter being positioned between the separate conduit and the pressure sensor.

20. The multi-cylinder engine of claim 16 further comprising a filter being positioned along the common conduit.

21. The multiple cylinder engine of claim 20, wherein the filter is positioned proximate the pressure sensor.

22. The multiple cylinder engine of claim 14, wherein each of the multiple intake conduits including a throttle body having a throttle valve that controls a flow of air there through.

* * * * *